US006407675B1

(12) United States Patent
Mumford et al.

(10) Patent No.: US 6,407,675 B1
(45) Date of Patent: Jun. 18, 2002

(54) TRAFFIC SIGN WARNING LIGHT AND METHOD THEREFOR

(75) Inventors: Robert B. Mumford, Henderson; Ron E. Kozloski, Reno, both of NV (US)

(73) Assignee: Performance Foam Products, LLC, Las Vegas, NV (US)

( * ) Notice: Subject to any disclaimer, the term of this patent is extended or adjusted under 35 U.S.C. 154(b) by 0 days.

(21) Appl. No.: 09/883,165

(22) Filed: Jun. 18, 2001

(51) Int. Cl.[7] ..... G08G 1/095

(52) U.S. Cl. ..... 340/907; 340/321; 340/332; 340/908; 40/586; 116/63 P; 362/109

(58) Field of Search ..... 340/907, 321, 340/337, 332, 693.5, 693.9, 908; 40/586; 116/63 P, 202; 362/109, 191, 368, 396, 812

(56) References Cited

U.S. PATENT DOCUMENTS

| | | | | | |
|---|---|---|---|---|---|
| 4,042,919 | A | * | 8/1977 | Patty | 340/321 |
| 5,023,607 | A | * | 6/1991 | Staten | 340/908.1 |
| 5,276,424 | A | * | 1/1994 | Hegemann | 340/321 |
| 6,031,468 | A | * | 2/2000 | Tsao et al. | 340/908 |
| 6,035,567 | A | * | 3/2000 | Cameron | 40/606 |
| 6,134,820 | A | * | 10/2000 | Martinez | 40/586 |
| 6,150,957 | A | * | 11/2000 | Henz et al. | 340/908 |
| 6,239,691 | B1 | * | 5/2001 | Preisler | 340/321 |

* cited by examiner

*Primary Examiner*—Nina Tong
(74) *Attorney, Agent, or Firm*—Jeffrey D. Moy; Harry M. Weiss; Weiss & Moy, P.C.

(57) ABSTRACT

A traffic sign warning light is used for providing a visual signal of the traffic sign. The traffic sign warning light has a body section for supporting the traffic warning light on a traffic sign. Lighting units are coupled to the body section. The lighting units provide a visual warning of the traffic sign.

2 Claims, 2 Drawing Sheets

TRAFFIC SIGN WARNING LIGHT AND METHOD THEREFOR

BACKGROUND OF THE INVENTION

1. Field of the Invention

This invention relates to traffic signs and, more specifically, to a warning light system to be installed on traffic signs to give drivers advance notice of the traffic sign.

2. Description of the Prior Art

Traffic safety is a growing concern through out the world. Each year, more and more people are being injured and/or fatally wounded due to vehicular accidents. Many of these accidents are caused by drivers who inadvertently failed to read and/or identify traffic warning signs. Many drivers are so preoccupied by activities in the vehicle (i.e., talking on a cellular phone, talking with passengers or children in the vehicle, trying to shave or put on make-up, etc.), that they fail to see traffic warning signs. Furthermore, with so many different signs and billboards on our roads today, many people fail to realize which signs are traffic warning signs and which signs are just advertisements.

Therefore, a need existed to provide an improved type of traffic warning sign. The improved traffic warning sign must have a device for signaling drivers of the traffic warning sign. The traffic warning sign signaling device must be able to provide different warning levels or stages. The traffic warning sign signaling device must further be easy to install and remove from any type of traffic warning sign.

SUMMARY OF THE INVENTION

In accordance with one embodiment of the present invention, it is an object of the present invention to provide an improved type of traffic warning sign.

It is another object of the present invention to provide an improved traffic warning sign that has a device for signaling drivers of the traffic warning sign.

It is still another object of the present invention to provide a traffic warning sign signaling device that is able to provide different warning levels or stages.

It is still another embodiment of the present invention to provide a traffic warning sign signaling device that is easy to install and remove from any type of traffic warning sign.

BRIEF DESCRIPTION OF THE PREFERRED EMBODIMENTS

In accordance with one embodiment of the present invention, a traffic sign warning light is disclosed. The traffic sign warning light has a body section for supporting the traffic sign warning light on a traffic sign. Lighting units are coupled to the body section. The lighting units provide a visual warning of the traffic sign.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, objectives, and advantages thereof, will best be understood by reference to the following detailed description of illustrated embodiment when read in conjunction with the accompanying drawings, wherein like reference numerals and symbols represent like elements.

DETAILED DESCRIPTION OF THE PREFERRED EMBODIMENT

Figure 1:
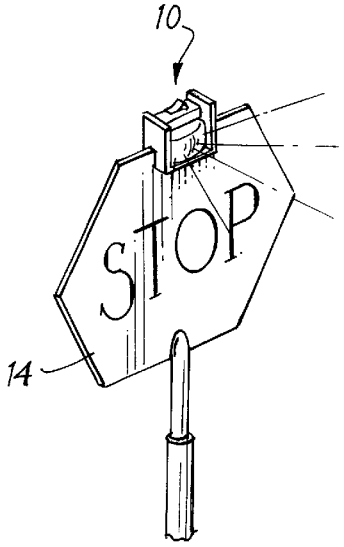
FIG. 1 is an elevated perspective view of the traffic sign warning light of the present invention mounted on a crossing guard stop sign.
Figure 2:
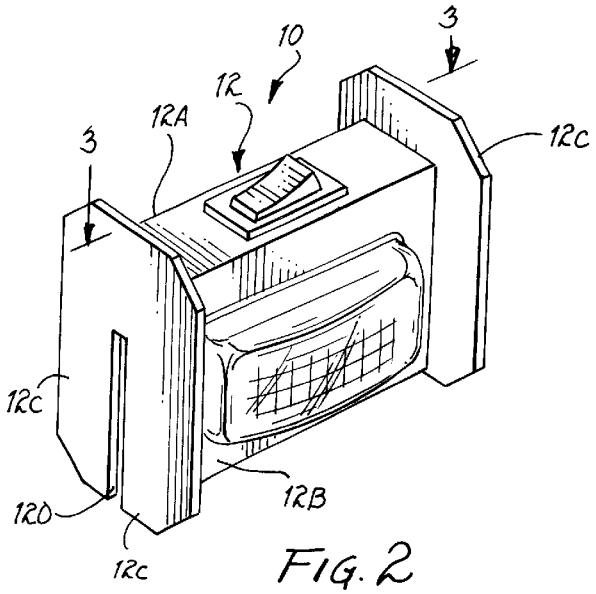
FIG. 2 is an elevated perspective view of the traffic sign warning light of the present invention.
Figure 4:
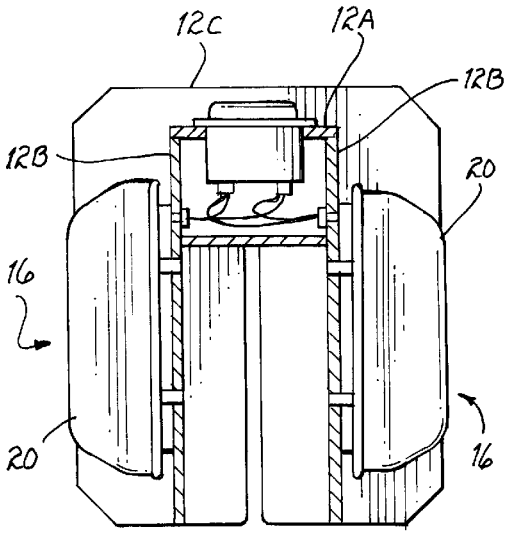
FIG. 4 is a cross-sectional side view of the traffic sign warning light of the present invention taken along lines 4—4 of FIG. 3.
Figure 3:
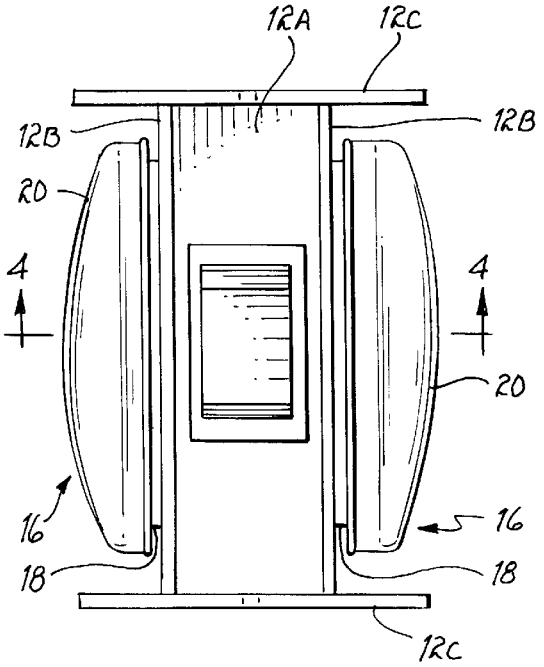
FIG. 3 is a top view of the traffic sign warning light of the present invention.

Referring to FIGS. 1–4 wherein like numerals and symbols represent like elements, a traffic sign warning light system 10 (hereinafter warning light 10) is shown. The warning light 10 has a body section 12. The body section 12 is used to support and house the warning light circuitry which will be discussed below. The body section 12 is further used to attach the warning light 10 to any type of traffic sign 14.

The body section 12 is semi hollow to allow the body section 12 to house the warning light circuitry and to allow the warning light 10 to be coupled to a traffic sign 14. The body section 12 comprises a top plate 12A. Coupled to the top plate 12A is a pair of side walls 12B. A pair of end plates 12C are coupled on each end of the body section 12 and attached to the top plate 12A and to each side wall 12B. The body section 12 is generally made out of a light weight and sturdy material. Some examples of the material that could be used include: aluminum, plastic, polycarbonates, and the like. It should be noted that these are only examples and should not be seen as to limit the scope of the present invention.

A slot 12D is located on each end plate 12C. The slot 12D is centrally located along the width of the end plate 12C and runs from a bottom section of the end plate 12C approximately two-thirds of the way up the height of the end plate 12C. When each end plate 12C is coupled to the body section 12, each slot 12D is approximately aligned with the other slot 12D. This will allow the warning light 10 to be positioned over the thickness of a traffic warning sign 14 as depicted in FIG. 1. Once the warning light 10 is placed over the thickness of the traffic sign 14, a locking device may be used to secure the warning light 10 to the traffic sign 14. The locking device may be used to removably couple the warning light 10 to the traffic sign 14 or more permanently couple the warning light 10 to the traffic sign 14. The locking device may be an adjustable clamp lock or something more permanent like locking screws. The locking device may even be hook and loop material or double sided tape. It should be noted that these are only examples of locking devices that could be used. It should not be seen as to limit the scope of the present invention.

Coupled to each side wall 12B is a reflective lighting unit 16. The reflective lighting unit 16 will provide a visual signal of the upcoming traffic sign 14. The reflective lighting unit 16 comprises a bottom plate 18. The bottom plate 18 is coupled to the side wall 12B. The bottom plate 18 supports a lighting circuit 30 which is shown in FIG. 6 and will be described below. A reflective cover 20 is coupled to the bottom plate 18. The reflective cover 20 intensifies the light from the lighting circuit 30 to provide an even greater visual signal of the upcoming traffic sign 14. The reflective cover 20 further protects the lighting circuit 30 from the environment. The reflective cover 20 may be made out of a clear or tinted (i.e., red or yellow tint similar to lights on an emergency vehicle) plastic material.

Referring now to FIG. 6, a simplified functional block diagram of the lighting circuit 30 is shown. The lighting circuit 30 will have a power source 32. The power source 32 is generally a battery. However, other power sources 32 may be used. For example, a small solar panel may be positioned on the top plate 12A of the body section 12 to power the lighting circuit 30 or recharge the batteries. A switch 34 is coupled to the power source 32. The switch 34 is used to activate or deactivate the lighting circuit 30. In the embodiment depicted in the Figures, the switch 34 is coupled to the top plate 12A of the body section 12. However, this is just an example and should not be seen as to limit the scope of the present invention.

Figure 5:
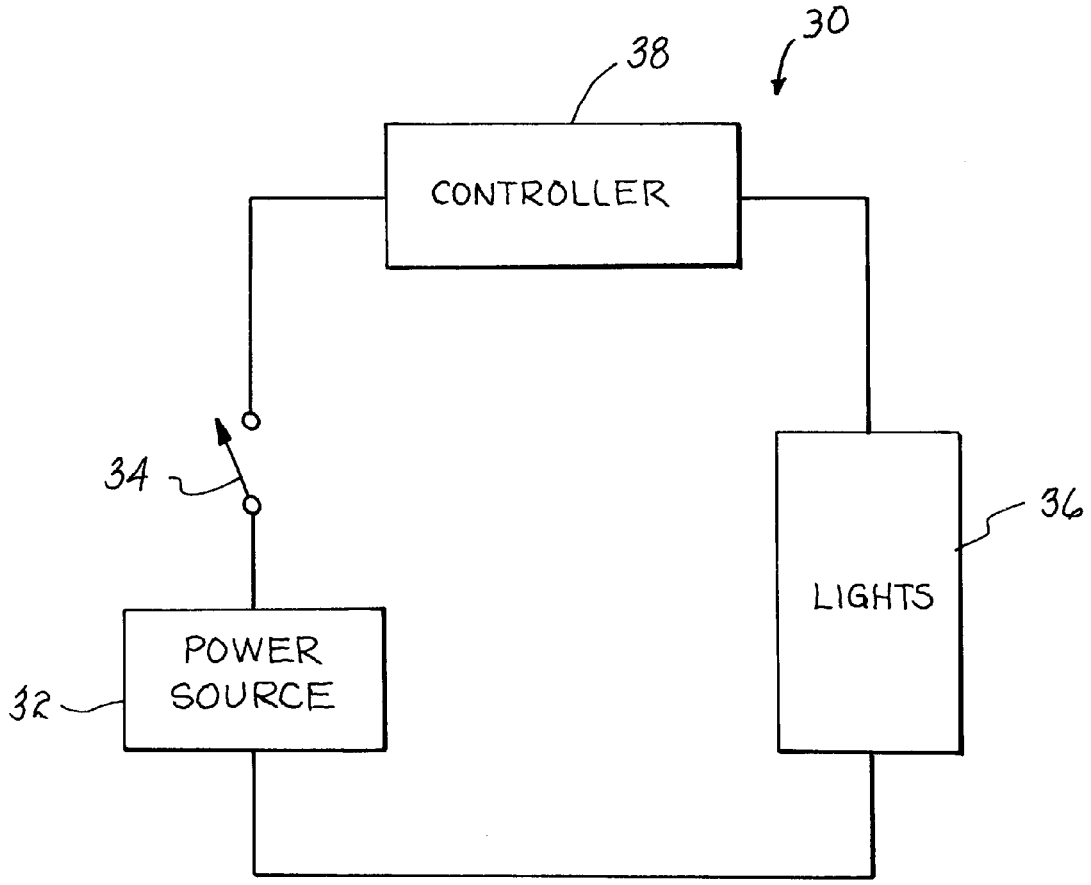
FIG. 5 is a simplified block diagram of one embodiment of the lighting circuitry used in the traffic sign warning light of the present invention.

The lighting circuit 30 will have one or more lights 36 coupled to the power supply 32. The lights 36 may be regular light bulbs or Light Emitting Diodes (LEDs). The lights 36 may be colored or clear or a combination thereof. A controller 38 is coupled to the lights 36. The controller 38 controls the operation of the lights 36 when the lighting circuit 30 is activated. For example, the controller 34 may have the lights 36 go off in a strobe like manner or a flashing manner. The controller 38 may allow only the yellow lights 36 to illuminate (caution lights) or red lights 36 to illuminate (warning lights). The controller 38 may further control the intensity of the lights 36. The controller 38 may have a switch to activate the different options of the lighting circuit 30. Alternatively, the controller 38 may have a built in receiver. The receiver would be able to receive different signals transmitted by a remote control transmitter to control the operation of the lighting circuit 30. The lighting circuit 30 depicted in FIG. 5 is shown as an example. Other lighting circuits 30 may be used.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A traffic sign warning light comprising, in combination:

a body section having a hollow interior section for supporting the traffic warning light on a traffic sign wherein the body section comprises:

a top plate section;

a pair of side wall sections; and a pair of end plates coupled to the top plate and to the pair of side walls wherein each of the pair of end plates has a slot running from a central bottom location up to approximately half way up the height of the end plate for placing the traffic warning light on the traffic sign; and lighting units coupled to the body section which provides a visual warning of the traffic sign wherein the lighting unit comprises:

a base plate coupled to the body section;

a lighting circuit coupled to the base plate wherein the lighting circuit comprises:

a plurality of colored lights;

a power supply coupled to the plurality of lights;

a switch coupled to the power supply; and a controller coupled to the plurality of lights for controlling the operation of the lights when the lighting circuit is activated and is able to have selected groups of the plurality of lights flash and strobe; and a reflective cover coupled to the base plate for protecting the lighting circuit from the environment and for intensifying a signal from the lighting circuit.

2. A traffic warning light in accordance with claim 1 wherein the controller is able to have the plurality of lights flash and strobe.

* * * * *